US005577853A

United States Patent [19]

Ushirooka

[11] Patent Number: 5,577,853

[45] Date of Patent: Nov. 26, 1996

[54] OPENING/CLOSING DEVICE FOR PIPE FILE BINDER

[75] Inventor: Kenji Ushirooka, Tokyo, Japan

[73] Assignee: Lion Office Products Corporation, Osaka hu, Japan

[21] Appl. No.: 413,278

[22] Filed: Mar. 30, 1995

[30] Foreign Application Priority Data

Mar. 30, 1994 [JP] Japan ..... 6-083894

[51] Int. Cl.[6] ..... B42F 3/02

[52] U.S. Cl. ..... 402/46

[58] Field of Search ..... 281/21.1, 36; 402/35, 402/46, 48

[56] References Cited

FOREIGN PATENT DOCUMENTS 52-52660 11/1977 Japan .
2-64081 5/1990 Japan .
2-32466 9/1990 Japan .
3-4551 2/1991 Japan .
3-87286 9/1991 Japan .
4-341898 11/1992 Japan .

*Primary Examiner*—Willmon Fridie, Jr.
*Attorney, Agent, or Firm*—Birch, Stewart, Kolasch & Birch, LLP

[57] ABSTRACT

An opening/closing device for a pipe file binder comprising a base, a pair of cover plates pivotally mounted on opposite longitudinal side portions of the base such that the cover plates can be opened and closed, the cover plates each being provided with an opening portion formed in a generally central portion thereof, a resilient member located between the cover plates on the base, a pair of levers provided on generally central portions of outer sides of the cover members and inserted in the opening portions, respectively, and by pressing the levers, a part of an outer side portion of the resilient member being disengaged from a part of an outer side portion of the base so that the cover plates are opened and disengaged.

19 Claims, 12 Drawing Sheets

OPENING/CLOSING DEVICE FOR PIPE FILE BINDER

BACKGROUND OF THE INVENTION

1. Field of the Invention

This invention relates to an opening/closing device for a pipe file binder.

2. Brief Description of the Prior Art

Among many kinds of file binders, the present invention relates to a comparatively thick (or heavy) file using a pipe, i.e., a pipe file binder in which a pair of cover plates (or closure plates) mounted on opposite longitudinal sides of a binder base can be opened and closed, and attached and detached in opposite directions.

Japanese Utility Model Publication No. Hei 3-4551, Japanese Laid-Open Utility Model Publication No. Hei 3-87286 and Japanese Laid-Open Patent Publication No. Hei 4-341898 disclose file binders of this type. However, these utility models and invention have the following shortcomings.

The above-mentioned Japanese Utility Model Publication No. Hei 3-4551 has such shortcomings that since engageable slip plates are mounted in side plates of a rotary member, a spine portion becomes thicker and therefore, a storage rack cannot be used effectively.

The second-mentioned Japanese Laid-Open Utility Model Publication No. Hei 3-87286 has such shortcomings that since shafts are pivotally supported on upper side portions of opposite side plates of a base and projection buttons extending through the side plates, respectively, are formed on inner slide pieces, a base plate portion of the binder becomes extremely thick and a surplus width is formed in a cover sheet direction.

The last-mentioned Japanese Laid-Open Patent Publication No. Hei 4-341898 indeed has successfully obviated the shortcomings had by the first and second mentioned prior publications. However, it again has another shortcoming in that since an engageable guide shaft is located under a group of sheets of paper, the user often finds it difficult to insert his/her finger to operate the guide shaft in a somewhat awkward manner.

Other publications such as Japanese Utility Model Publication No. Sho 52-52660, Japanese Utility Model Publication No. Hei 2-32466 and Japanese Laid-Open Utility Model Publication No. Hei 2-64081 are also known. However, the devices disclosed by those publications are all found to be difficult to operate smoothly and therefore, hardly put into actual practice.

SUMMARY OF THE INVENTION

It is, therefore, an object of the present invention to provide a pipe file binder which is free from the above-mentioned shortcomings inherent in the conventional devices and which can be easily put into practical use.

To achieve the above object, according to one aspect of the present invention, there is essentially provided an opening/closing for a pipe file binder comprising a base; a pair of cover plates pivotally mounted on opposite longitudinal side portions of the base such that the cover plates can be opened and closed, the cover plates each being provided with an opening portion formed in a generally central portion thereof; a resilient member located between the cover plates on the base; a pair of levers provided on generally central portions of outer sides of the cover members and inserted in the opening portions, respectively; and by pressing the levers, a part of an outer side portion of the resilient member being disengaged from a part of an outer side portion of the base so that the cover plates are opened and disengaged.

According to another aspect of the present invention, there is also provided an opening/closing device for a pipe file binder comprising a base a pair of cover plates pivotally mounted on opposite longitudinal side portions of the base such that the cover plates can be opened and closed, the cover plates each being provided with an opening portion formed in a generally central portion thereof; a resilient member located between the cover plates on the base, the resilient member including a spring portion having a diverged configuration in a plan view and engagement means pivotally attached to the cover plates; a pair of levers provided on generally central portions of outer sides of the engagement means and inserted in the opening portions, respectively; and by pressing the levers, a part of an outer side portion of the resilient member being disengaged from a part of an outer side portion of the base so that the cover plates are opened and disengaged.

From a third aspect of the present invention, there is also provided an opening/closing device for a pipe file binder comprising a base; a pair of cover plates pivotally mounted on opposite longitudinal side portions of the base such that the cover plates can be opened and closed, the cover plates each being provided with a cut-out opening portion formed in a generally central portion thereof; a pair of resilient members located between the cover plates on the base, the resilient members each having a generally zigzag configuration; a pair of levers disposed on generally central portions of the resilient members and inserted in the opening portions, respectively; and by pressing the levers, a part of an outer side portion of the resilient member being disengaged from a part of an outer side portion of the base so that the cover plates are opened/closed and attached/detached.

In order to remove one of the tubular members disposed between the pair of cover plates by opening one of the cover plates of the binder firmly secured to the spine between the front and back cover sheets, firstly, the lever projecting through the opening portion of one of the cover plates is pressed by a finger placed on the finger-catch portion of the lever until a part of the resilient member on the inner side of the lever contacts the projection. By doing this, the finger-catch portion of the lever is brought down to the level of the side walls of the base and held in parallel relation with the side walls.

As a consequence, the outer engagement portion at one side portion integral with the resilient member attached with the lever is disengaged from the window opening on the cover plate side and the member-to-be-engaged is disengaged from the side wall of the base. Therefore, if the cover plate is lifted up by the other hand, its lower side portion and the lower edge portion of the window opening are disengaged from the outer side edge portion of the base.

Also, by doing this, the lower side portion of the other cover plate and the lower edge portion of the window opening are opened outwardly while being held in engagement with the outer side edge portion of the base.

Accordingly, in such an opening state of one of the cover plates, the rod portion of the cover plate may be simply removed from the tubular member of the other cover plate. Thereafter, paper sheets, etc. are filed on this tubular portion.

The above-mentioned disengaging operation of the cover plate can also be achieved by pressing the finger-catch portion of one of the levers.

In order to close the cover plates after the paper sheets, etc. have been filed, the same operation is made in the reverse way.

The above and other objects and attendant advantages of the present invention will be apparent to those skilled in the art from a reading of the following description and claims in conjunction with the accompanying drawings which constitute part of this specification.

BRIEF DESCRIPTION OF THE DRAWING

The present invention will become more fully understood from the detailed description given hereinbelow and the accompanying drawings which are given by way of illustration only, and thus, are not limitative of the present invention and wherein.

DETAILED DESCRIPTION OF THE EMBODIMENT

Figure 1:
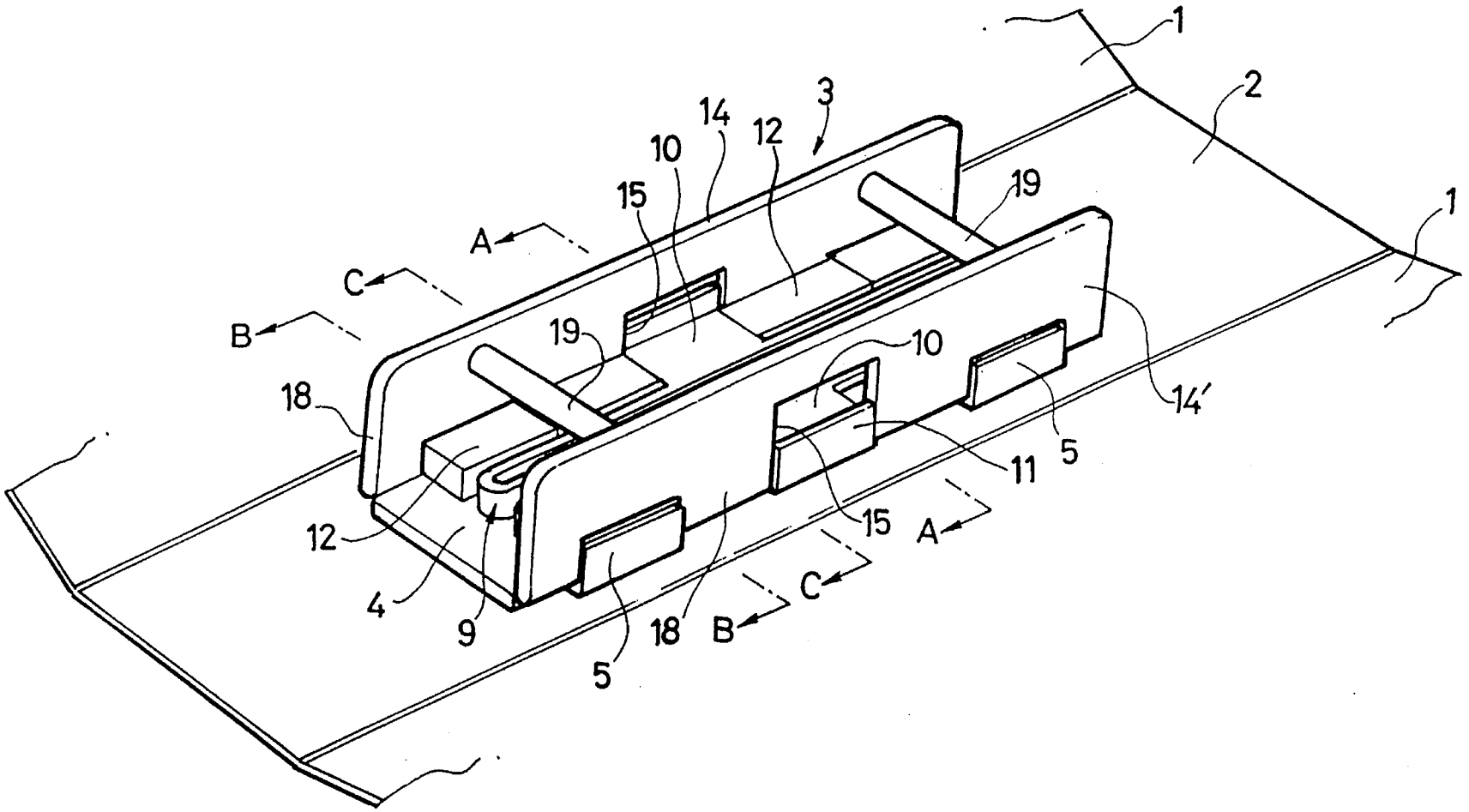
FIG. 1 is a perspective view of an overall construction of an opening/closing device for a pipe file binder according to a first embodiment of the present invention.

A first embodiment of the present invention will now be described with reference to FIGS. 1 to 8 inclusive.

Reference numerals 1, 1 denote cover members (stiffening members), respectively and reference numeral 2 denotes a spine. A book binder (or page binder) 3, which has such a construction as hereinafter described, is firmly secured to a central area of the spine 2.

Reference numeral 4 denotes a base. On an upper surface of the base 4, a resilient member 9 and a pair of cover plates 14, 14' as later described are located. The base 4 has a projection 21 projecting upwardly from a central area of the upper surface of the base 4 and adapted to act as a stopper.

Figure 2:
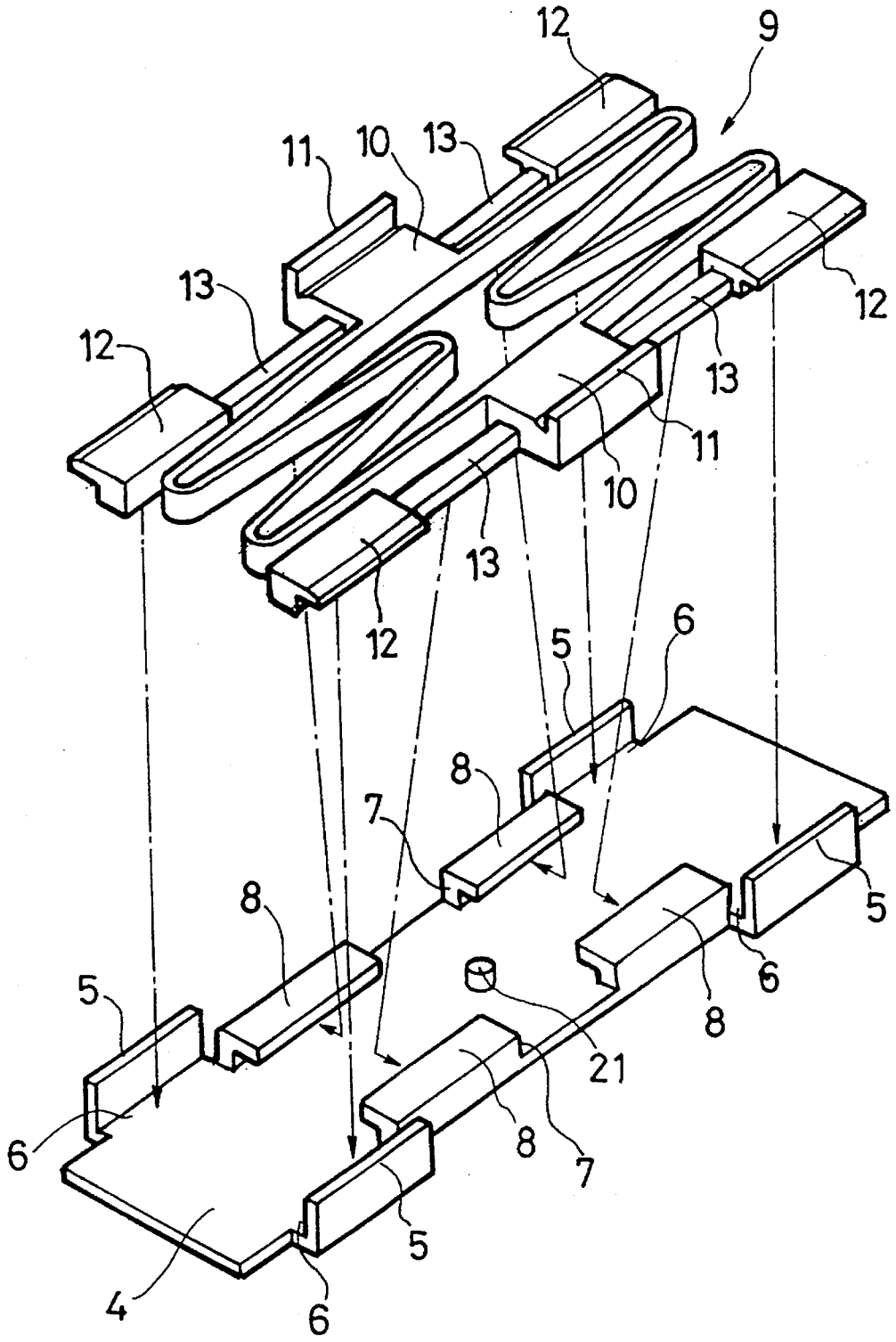
FIG. 2 is an exploded perspective view showing interrelation of component parts, during one stage of an assembling work, of an important portion of the opening/closing device of FIG. 1.
Figure 3:
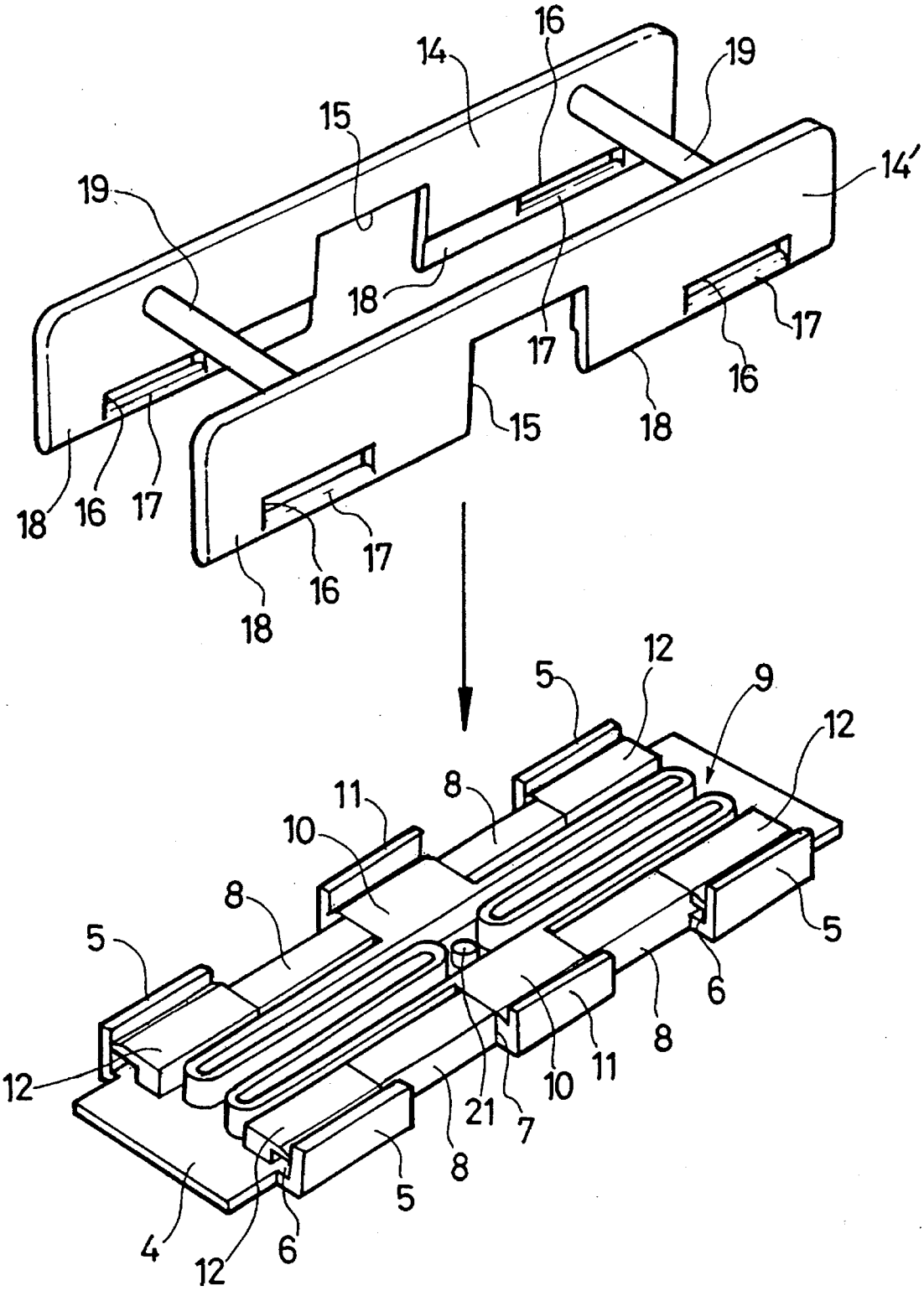
FIG. 3 is likewise an exploded perspective view showing interrelation of component parts, during another stage of an assembling work, of an important portion of the opening/closing device of FIG. 1.
Figure 4:
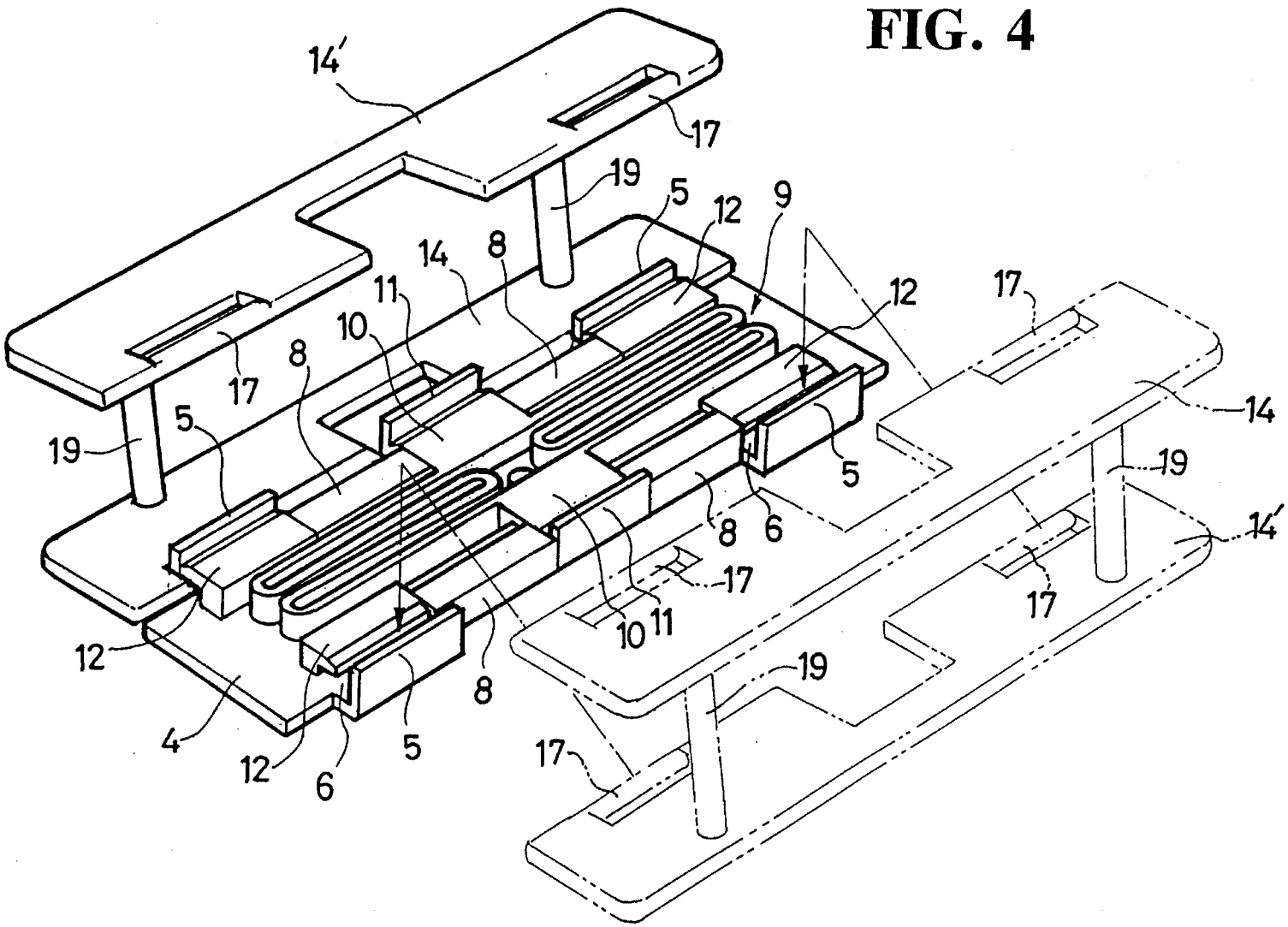
FIG. 4 is a perspective view of the important portion in use.
Figure 5:
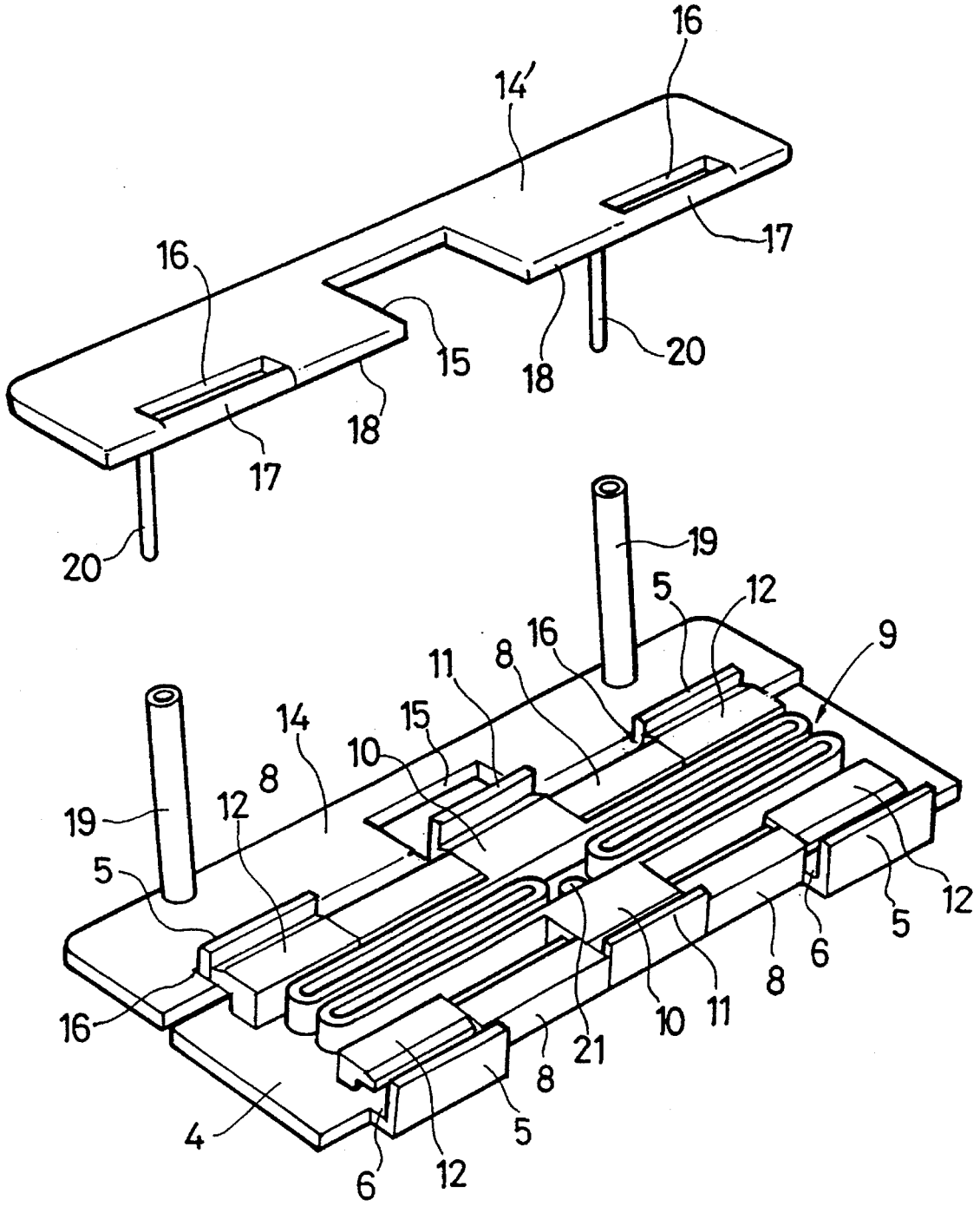
FIG. 5 is likewise a perspective view of the important portion in use.
Figure 6:
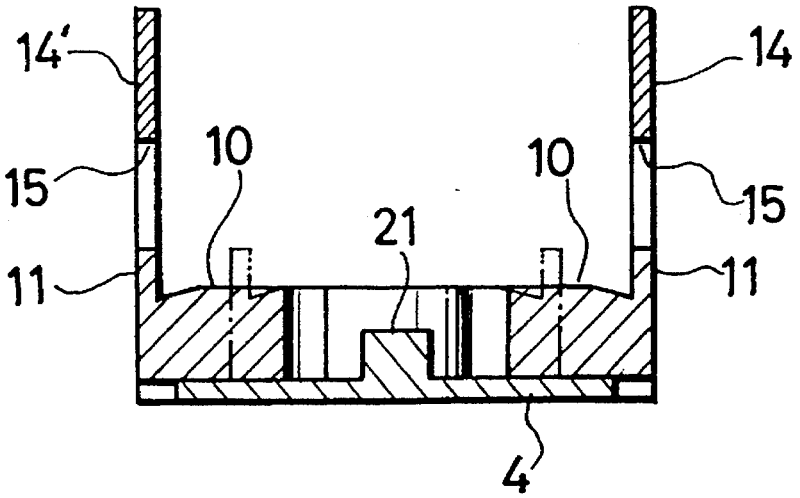
FIG. 6 is a cross-sectional view taken on line A—A of FIG. 1.
Figure 7:
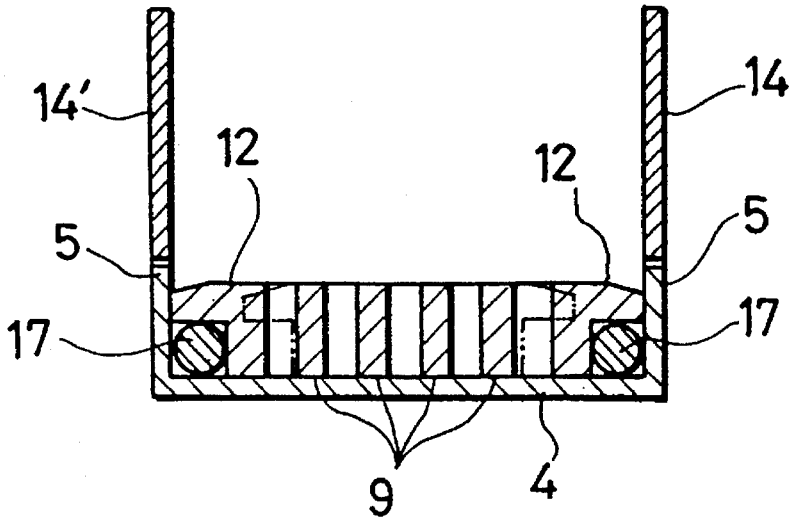
FIG. 7 is likewise a cross-sectional view taken on line B—B of FIG. 1.
Figure 8:
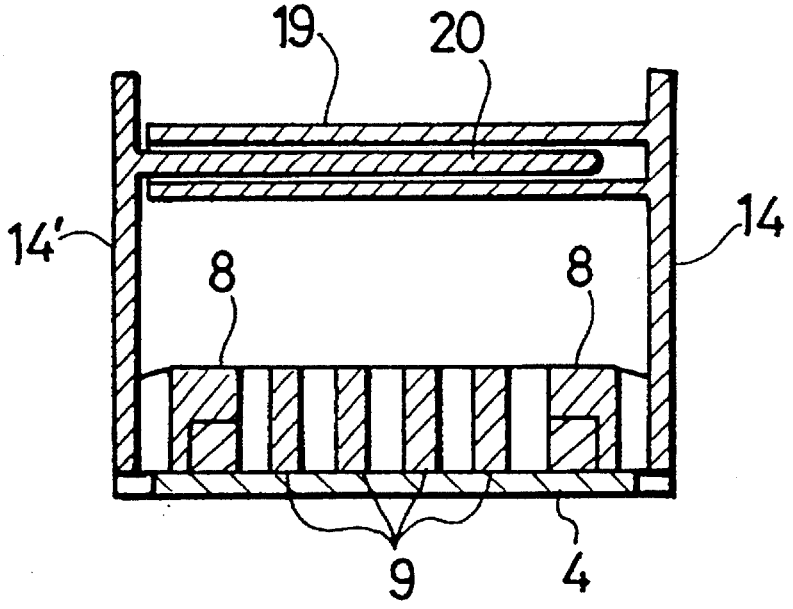
FIG. 8 is likewise a cross-sectional view taken on line C—C of FIG. 1.
Figure 9:
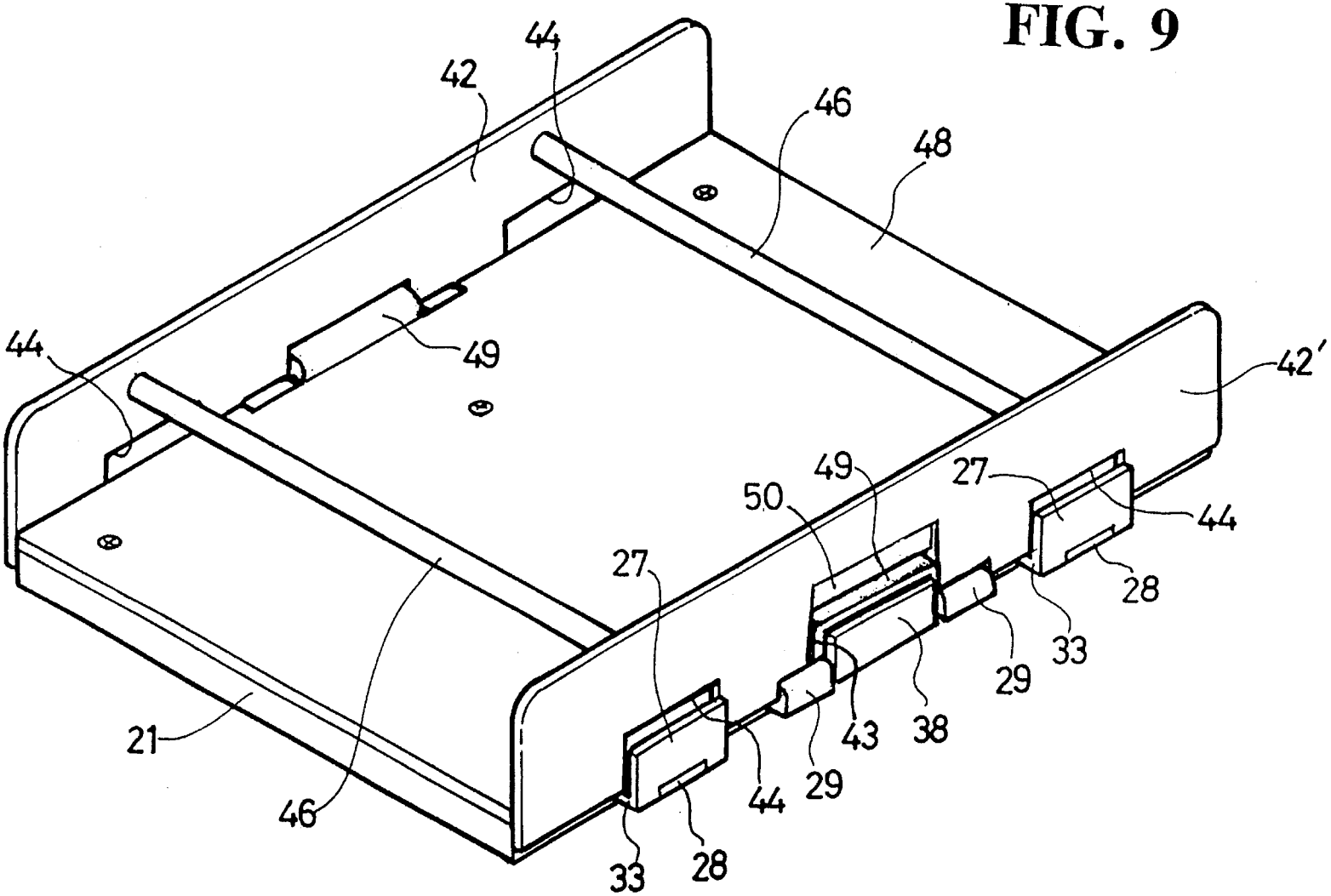
FIG. 9 is an overall perspective view, when in use, of an overall construction of an opening/closing device for a pipe file binder according to a second embodiment of the present invention.

Reference numerals 5, 5, 5, 5 denote two pairs of upstanding walls mounted on opposite longitudinal sides of the base 4 through two pairs of horizontal protrusions 6, 6, 6, 6 continuous from lower ends of the upstanding walls 5, 5, 5, 5 to the longitudinal sides of the base 4, respectively, as shown in FIG. 2 and elsewhere. Opening portions 7, 7 are formed at central portions of the opposite longitudinal sides of the base 4. A pair of inverted L-shaped side walls 8, 8 are formed between the right-hand sides of one pair of upstanding walls 5, 5 and the left-hand sides of the opening portions 7, 7, and another pair of inverted L-shaped side walls 8, 8 are formed between the right-hand sides of the opening portions 7, 7 and the left-hand sides of another pair of upstanding walls 5, 5.

Reference numeral 9 denotes a resilient member laid in a large zigzag pattern on the upper surface of the base 4. A pair of levers 10, 10 are provided respectively on central portions of opposite longitudinal sides of the resilient member 9. For mounting the resilient member 9 on the base 4, the levers 10, 10 are inserted respectively into the opening portions 7, 7 of the base 4. The length of each lever 10 is equal to the protruded length of each protrusion 6. The levers 10 are provided with finger-catch portions 11, 11 extending upwardly from outer ends thereof, respectively.

The levers 10, 10, when not in use, are urged outwardly under the effect of the resilient member 9, so that the finger-catch portions 11, 11 on the levers 10, 10 are brought to be in alignment with the upstanding walls 5, 5, 5, 5 on the base 4.

Reference numerals 12, 12, 12, 12 denote inverted L-shaped outer engagement portions formed on opposite end portions of opposite longitudinal sides of the resilient member 9. Outer end portions of the outer engagement portions 12, 12, 12, 12 are brought into engagement with window openings 16, 16, 16, 16 formed in opposite end portions of the opposite cover plates 14, 14' and held on the inner side of and opposite to the upstanding walls 5, 5, 5, 5, respectively.

Between the levers 10, 10 and the outer engagement portions 12, 12, 12, 12 of the resilient member 9, members-to-be-engaged 13, 13, 13, 13 which are lower than them, are formed, respectively, as best shown in FIG. 2. The members-to-be-engaged 13, 13, 13, 13 are brought into engagement with inner sides of the reversed-L-shaped side walls 8, 8, 8, 8 formed on the base 4, respectively.

Reference numerals 14, 14' denote cover members disposed on opposite longitudinal sides of the base 4. The cover members 14, 14' are provided with opening portions 15 formed by cutting generally central portions of the cover members 14, 14' from their lower edges, respectively and also with elongated window openings 16, 16, 16, 16 formed in the cover members 14, 14' with the opening portions 15, 15 therebetween, respectively.

The upstanding walls 5, 5, 5, 5 on the base 4 are brought into engagement with the window openings 16, 16, 16, 16 of the cover plates, 14, 14', respectively. Similarly, the outer engagement portions 12, 12, 12, 12 of the resilient member 9 are brought into engagement with lower edge portions (shaft-like) 17, 17, 17, 17 of the elongated window openings 16, 16, 16, 16, respectively.

The levers 10, 10 of the resilient members 9 can be moved in and out of the opening portions 15, 15 of the cover members 14, 14', respectively. However, if the heights of the opening portions 15, 15 are twice as high as the heights of the finger-catch portions 11, 11 of the levers, the finger can be smoothly placed on the finger-catch portions 11, 11.

The thickness of those lower side portions 18, 18 of the cover plates 14, 14' including the lower edge portions of the elongated window openings 16, 16, 16, 16 but excluding the opening portions 15, 15 is equal to the protruded length of the horizontal protrusions 6, 6, 6, 6 of the base 4. Owing to this arrangement, the lower side portions of the cover members 14, 14' are brought respectively into abutment with the inner surfaces of the upstanding walls 5, 5, 5, 5 and with the outer surfaces of the side walls 8, 8, 8, 8 which are raised when the lower edge portions 17, 17, 17, 17 of the window openings 16, 16, 16 are brought into engagement with the inner sides of the upstanding walls 5, 5, 5, 5, respectively. As a consequence, the cover plates become ready to be opened and closed about the outer engagement portions 12, 12, 12, 12 which are in engagement relation with the window openings 16, 16, 16, 16. When the cover plates are opened, they can be pivoted from the position shown in FIG. 1 to the solid line or dotted line position shown in FIG. 4. Accordingly, the finger-catch portions 11, 11 of the levers 10, 10 are held in parallel relation with the upstanding walls 5, 5, 5, 5 of the base 4, on the outer sides of the cover plates 14, 14' when the cover plates are not in operation (file is in use).

Reference numerals 19, 19 denote tubular members disposed on an inner surface of one of the cover plates, 14. Rod members 20, 20 to be fitted into the tubular members 19, 19 are disposed on an inner surface of the other cover plate 14'.

Although a cover plate is actually attached to an upper surface portion of the resilient member 9 in such a manner as to be faced with the base 4, such a cover member is omitted from the drawings.

A second embodiment of the present invention will now be described with reference to FIGS. 9 to 14 inclusive.

Reference 21 denotes a base and has recesses 22, 22 formed along opposite longitudinal side portions of the base 21.

Reference numerals 23, 23 denote projections formed on generally central portions of inner surfaces of the recesses 22, 22, respectively. Inner wall surfaces 24, 24 are formed with each projection 23 situated therebetween.

Reference numeral 25 denotes an inlet/outlet portion which is formed in a generally central portion of an outer side edge portion of each recess 22. Horizontal protruded portions 26, 26 are protruded outwardly from and along the outer edge portions of the recesses on both sides of the inlet/outlet portion 25. The horizontal protruded portions 26, 26 are provided with the upstanding walls 27, 27, respectively.

Figure 10:
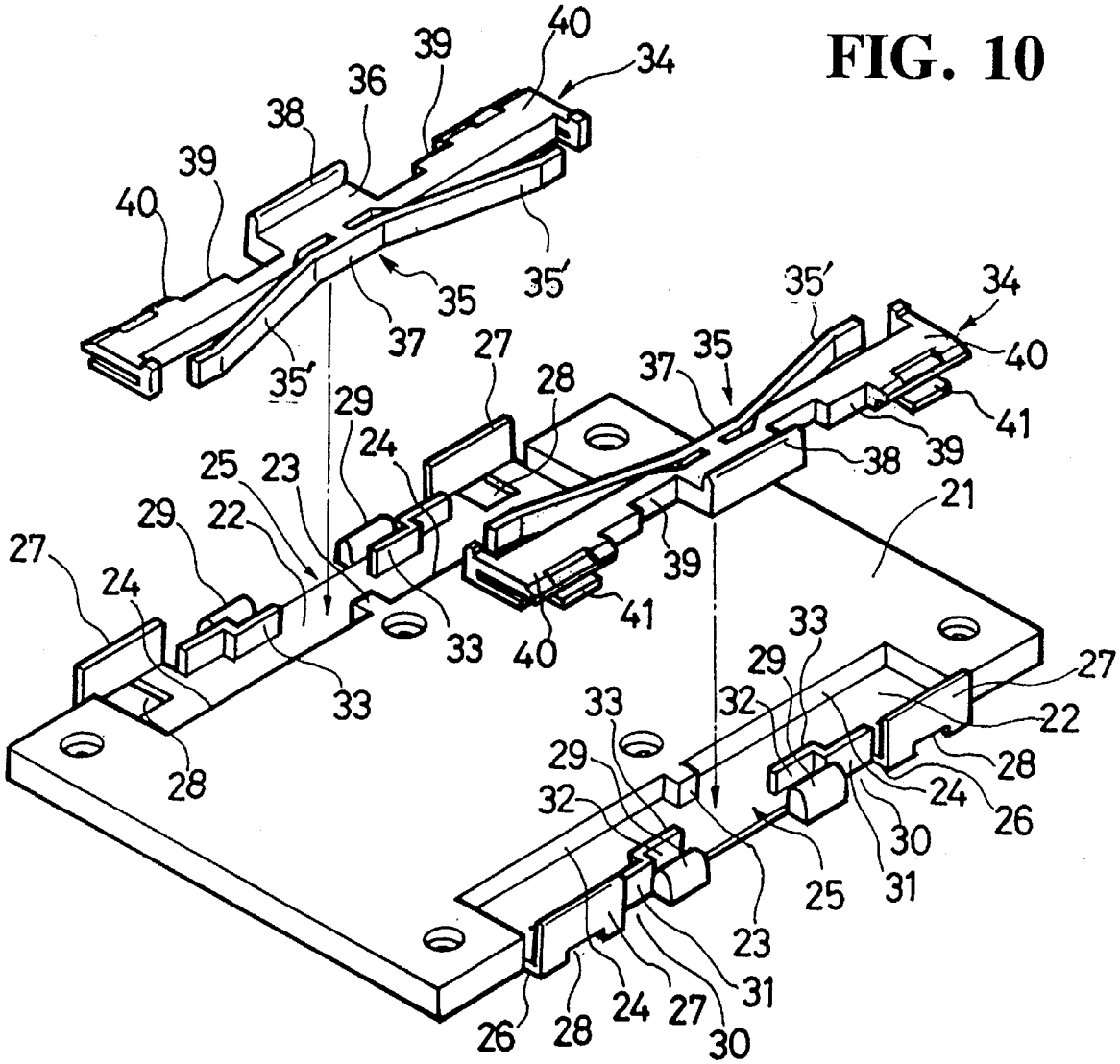
FIG. 10 is an exploded perspective view showing interrelation of component parts, during one stage of an assembling work, of an important portion of the binder of FIG. 9.

The upstanding walls 27, 27 are provided respectively with grooves 28, 28 which are formed in angular portions (right angle) with respect to the recess 22. Step portions each comprising a raised portion 29 and a depressed portion 30 are formed between the inlet/outlet portion 25 and the upstanding walls 27, 27, respectively, as best shown in FIG. 10.

In the base recess portion on the inner side of the step portions, a front wall 31 is formed on the depressed portion 30 and a rear wall 33 is formed on the raised portion 29 with the depressed portion 32 disposed therebetween, respectively, along the step portion.

Reference numerals 34, 34 denote resilient members received in the recesses 22, 22 of the base 21, respectively. Each resilient member 34 comprises an inner spring portion 35 and an outer engagement portion 36.

Each spring portion 35 has a diverged configuration in a plan view and comprises a pair of blade portions 35', 35' and a basal portion 37 disposed therebetween. This basal portion 37 can be brought into and out of contact with the projection 23 of the recesses 22, 22, while the blade portions 35', 35' are normally in contact with the inner wall surfaces 24, 24 of the recesses 22, 22 under pressure.

Reference 38 denotes a lever disposed at a generally central portion of the engagement portion 36. This lever 38 is provided at an outer end thereof with a finger-catch portion. The arrangement being such that by pressing this lever with a finger, the blade portions 35, 35' of the spring portion 35 are biased.

Double stepped depressed portions 39, 39 are formed on each side of the lever 38, respectively.

Reference numerals 40, 40 denote outer engagement portions formed on outer end portions of the depressed portions 39, 39 of the finger-catch portion 36, respectively, and tongue elements 41, 41 are formed on and allowed to project from the outer engagement portions 40, 40, respectively. The tongue elements are brought into engagement with the grooves 28, 28 formed in the upstanding walls 27, 27 disposed on each side of the base recesses 22, 22, respectively.

Reference numerals 42, 42' denote cover plates disposed on each side of the base 21. The cover plates 42, 42' are provided with cut-out opening portions 43, 43 formed by cutting generally central portions of the cover members 42, 42' from their lower edges, respectively and also with window openings 44, 44, 44, 44 formed in the cover members 42, 42' with the opening portions 43, 43 therebetween, respectively.

The upstanding plates 27, 27, 27, 27 on the base 21 are brought into engagement respectively with the window openings 44, 44, 44, 44 formed in the cover plates 42, 42 disposed on the inner side of the upstanding walls, and the tongue elements 41, 41, 41, 41 of the outer engagement portions 40, 40, 40, 40 on the resilient member 34 are brought into engagement respectively with the lower edge portions (shaft-like) 45, 45, 45, 45 of the windows.

The finger-catch portions of the levers 38, 38 of the resilient member 34 are movable into and out of the opening portions 43, 43 of the cover plates 42, 42', respectively. In order for the finger to be smoothly placed on the finger-catch portion, a depressed surface 50 is formed in each of the opening portions 43, 43.

Figure 11:
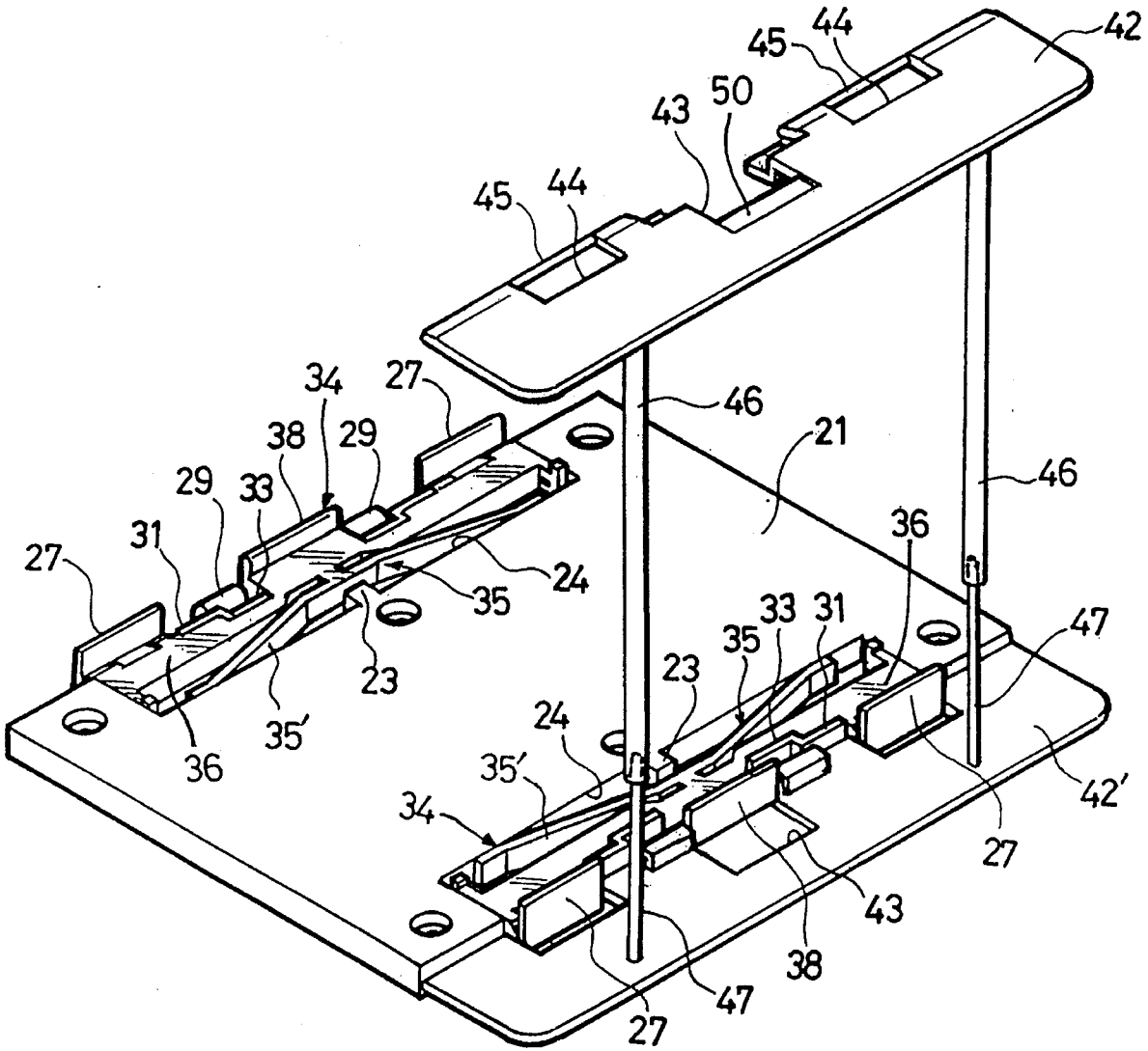
FIG. 11 is a perspective view showing interrelation of component parts, during another stage of an assembling work, of an important portion of the binder of FIG. 9.
Figure 12:
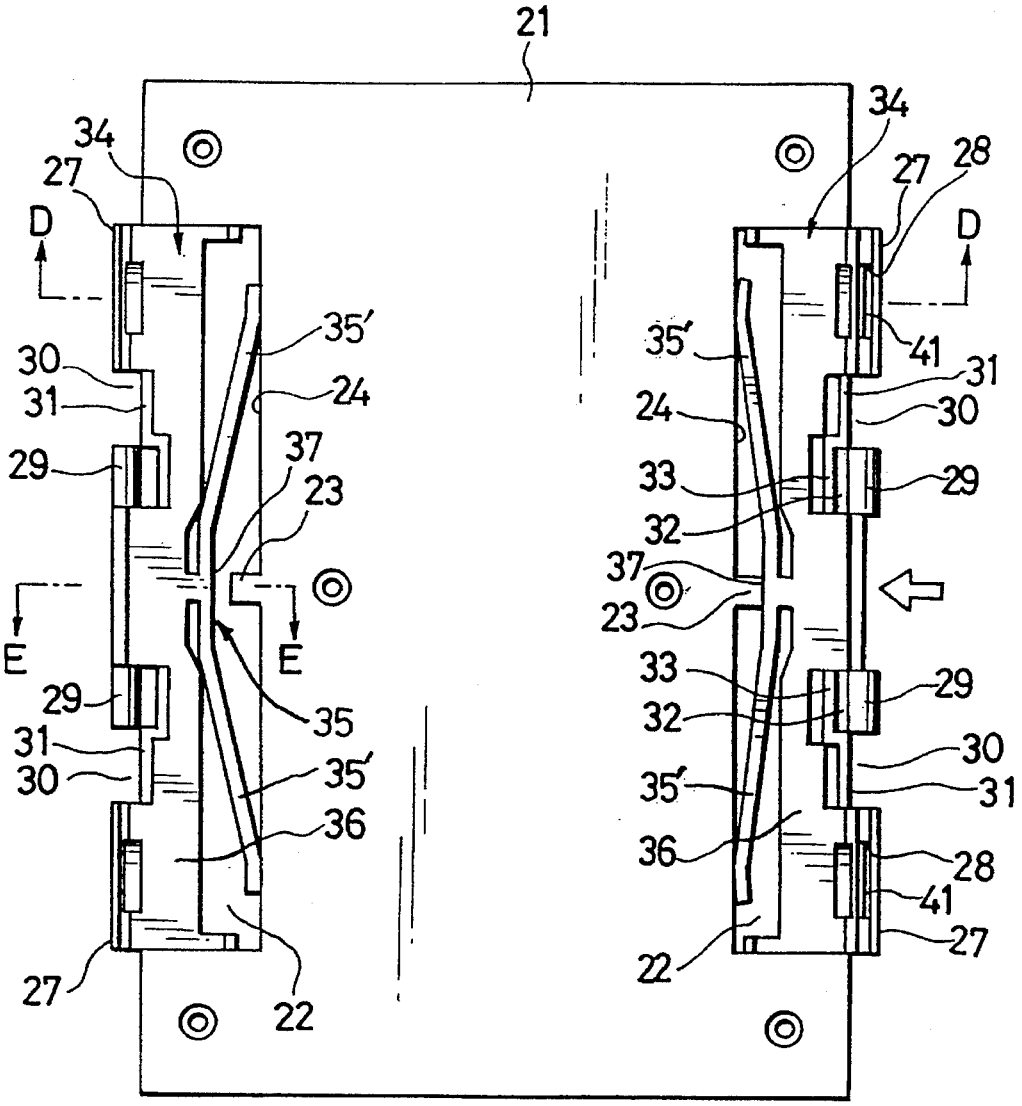
FIG. 12 is a plan view of the important portion after the completion of an assembling work.
Figure 13:
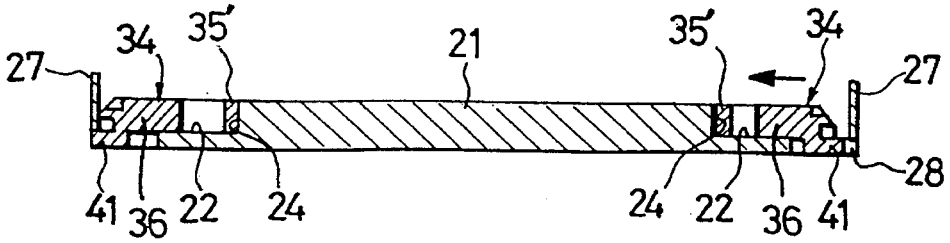
FIG. 13 is a cross-sectional view taken on line D—D of FIG. 12.
Figure 14:
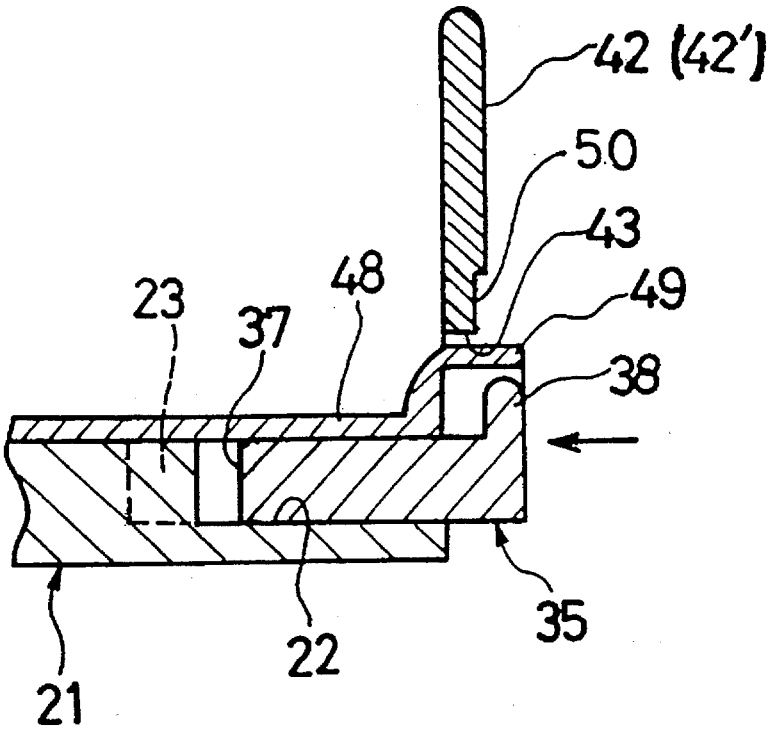
FIG. 14 is an enlarged cross-sectional view taken on line E—E of FIG. 12.

The thickness of those lower side portions of the cover plates 42, 42' including the lower edge portions 45, 45, 45, 45 of the window openings 44, 44, 44, 44 but excluding the opening portions 43, 43 is equal to the protruded length of the horizontal protrusions 26, 26, 26, 26 of the base 21. Owing to this arrangement, the lower side portions of the cover plates 42, 42' are brought into abutment respectively with the outer engagement portions 40, 40 of the finger-catch portion 36 of the resilient members 34, 34 when the lower edge portions of the window openings are brought into engagement with the inner sides of the upstanding walls 27, 27, 27, 27, respectively. As a consequence, the cover plates become ready to be opened and closed about the outer engagement portions 40, 40, 40, 40 which are in engagement relation with the window openings 44, 44, 44, 44. The cover plates 42, 42' are pivotable from the FIG. 9 position to an open position as shown in FIG. 11. Accordingly, the finger-catch portions of the levers 38, 38 are held in parallel relation with the upstanding walls 27, 27, 27, 27 of the base 21, on the outer sides of the cover plates 42, 42' which are raised when the cover plates are not in operation (file is in use).

Reference numerals 46, 46 denote tubular members disposed on an inner surface of one of the cover plates, 42. Rod members 46, 46 to be fitted into the tubular members 47, 47 are disposed on an inner surface of the other cover plate 42'.

A cover plate 48 is attached to an upper surface portion of the base 21 on which the resilient members 34, 34 are placed. Cover plates 49, 49 for covering the finger-catch portions of the levers 38, 38 of the resilient members 34, 34 are formed generally at the centers on each side of the cover plate 48.

When a binder of the present invention is used, the cover plate can be extremely easily disengaged and opened because the resilient member can be contracted by one touch operation of the lever or by operation of selected one of the levers. As a consequence, paper sheets, etc. can be rapidly and easily filed in and removed from the pipe file.

While some preferred embodiments of an opening/closing device for a pipe file binder according to the present invention have thus far been described with reference to the drawings, it should be borne in mind that such embodiments are merely illustrative of the gist of the present invention and are accordingly subject to modification and change.

What is claimed is:

1. An opening/closing device for a pipe file binder comprising:

a base;

a pair of cover plates pivotally mounted on opposite longitudinal side portions of said base such that said cover plates can be opened and closed about pivot axes, said cover plates each being provided with an opening portion formed in a generally central portion thereof;

a pair of levers provided on generally central portions of outer sides of said cover plates and inserted in said opening portions, respectively, each of the levers having a different one of the pivot axes for the cover plates passing therethrough; and by pressing said levers, a part of an outer side portion of said resilient member being disengaged from a part of an outer side portion of said base so that said cover plates are opened and disengaged.

2. An opening/closing device for a pipe file binder comprising:

a base;

a pair of cover plates pivotally mounted on opposite longitudinal side portions of said base such that said cover plates can be opened and closed about pivot axes, said cover plates each being provided with an opening portion formed in a generally central portion thereof;

a resilient member located between said cover plates on said base, said resilient member including a spring portion having a diverged configuration in a plan view and engagement means pivotally attached to said cover plates;

a pair of levers provided on generally central portions of outer sides of said resilient member and inserted in said opening portions, respectively, each of the levers having a different one of the pivot axes for the cover plates passing therethrough; and by pressing said levers, a part of an outer side portion of said resilient member being disengaged from a part of an outer side portion of said base so that said cover plates are opened and disengaged.

3. An opening/closing device for a pipe file binder comprising:

a base;

a pair of cover plates pivotally mounted on opposite longitudinal side portions of said base such that said cover plates can be opened and closed about pivot axes, said cover plates each being provided with a cut-out opening portion formed in a generally central portion thereof;

a resilient member located between said cover plates on said base, said resilient member having a generally zigzag configuration;

a pair of levers disposed on generally central portions of said resilient member and inserted in said opening portions, respectively, each of the levers having a different one of the pivot axes for the cover plates passing therethrough; and by pressing said levers, a part of an outer side portion of said resilient member being disengaged from a part of an outer side portion of said base so that said cover plates are openable and closable.

4. The opening/closing device as recited in claim 1, wherein the resilient member has two sides with each side having a zig-zag configuration, the pair of levers being mounted on opposed sides of the resilient member.

5. The opening/closing device as recited in claim 1, wherein the resilient member includes a spring portion and engagement means, the pair of levers being mounted on generally central portions of outer sides of the resilient member and the spring portions having a diverged configuration in a plan view.

6. The opening/closing device as recited in claim 5, wherein the spring portion includes a pair of blade portions extending from the central portions of the outer sides of the resilient member.

7. The opening/closing device as recited in claim 1, wherein each of the cover plates has at least one elongated window opening formed therein and wherein each of the elongated window openings has a lower edge portion, the pivot axes pass through the lower edge portions of the elongated window openings formed in the cover plates, the at least one elongated window opening on each cover plate being to one side of the opening portion formed in the generally central portion of the cover plate.

8. The opening/closing device as recited in claim 7, wherein the lower edge portions have a generally circular configuration in cross section.

9. The opening/closing device as recited in claim 7, wherein the part of the outer side portion of the resilient member disengaged from the part of the outer side portion of the base is insertable into the at least one elongated window.

10. The opening/closing device as recited in claim 9, wherein the part of the outer side portion of the base is at least one wall mounted on opposite longitudinal sides of the base.

11. The opening/closing device as recited in claim 2, wherein the spring portion includes a pair of blade portions extending from the central portions of the outer sides of the resilient member.

12. The opening/closing device as recited in claim 2, wherein each of the cover plates has at least one elongated window opening formed therein and wherein each of the elongated window openings has a lower edge portion, the pivot axes pass through the lower edge portions of the elongated window openings formed in the cover plates, the at least one elongated window opening on each cover plate being to one side of the opening portion formed in the generally central portion of the cover plate.

13. The opening/closing device as recited in claim 12, wherein the part of the outer side portion of the resilient member disengaged from the part of the outer side portion of the base is insertable into the at least one elongated window.

14. The opening/closing device as recited in claim 13, wherein the part of the outer side portion of the base is at least one wall mounted on opposite longitudinal sides of the base.

15. The opening/closing device as recited in claim 3, wherein the resilient member has two sides with each side having the zig-zag configuration.

16. The opening/closing device as recited in claim 3, wherein each of the cover plates has at least one elongated window opening formed therein and wherein each of the elongated window openings has a lower edge portion, the pivot axes pass through the lower edge portions of the elongated window openings formed in the cover plates, the at least one elongated window opening on each cover plate being to one side of the opening portion formed in the generally central portion of the cover plate.

17. The opening/closing device as recited in claim 16, wherein the lower edge portions have a generally circular configuration in cross section.

18. The opening/closing device as recited in claim 16, wherein the part of the outer side portion of the resilient member disengaged from the part of the outer side portion of the base is insertable into the at least one elongated window.

19. The opening/closing device as recited in claim 18, wherein the part of the outer side portion of the base is at least one wall mounted on opposite longitudinal sides of the base.

* * * * *